US008500986B1

(12) United States Patent
Schuh et al.

(10) Patent No.: US 8,500,986 B1
(45) Date of Patent: Aug. 6, 2013

(54) METHODS FOR THE IMPLEMENTATION OF NANOCRYSTALLINE AND AMORPHOUS METALS AND ALLOYS AS COATINGS

(75) Inventors: Christopher Schuh, Ashland, MA (US); Alan Lund, Framingham, MA (US)

(73) Assignee: Xtalic Corporation, Marlborough, MA (US)

( * ) Notice: Subject to any disclaimer, the term of this patent is extended or adjusted under 35 U.S.C. 154(b) by 1114 days.

(21) Appl. No.: 11/844,238

(22) Filed: Aug. 23, 2007

Related U.S. Application Data

(62) Division of application No. 11/383,969, filed on May 18, 2006, now Pat. No. 7,521,128.

(51) Int. Cl.
*C25D 3/56* (2006.01)
*C25D 7/06* (2006.01)

(52) U.S. Cl.
USPC ..... 205/255; 205/145; 205/150

(58) Field of Classification Search
USPC ..... 205/115, 143, 145, 150, 255
See application file for complete search history.

(56) References Cited

U.S. PATENT DOCUMENTS

| | | | | |
|---|---|---|---|---|
| 5,342,503 | A * | 8/1994 | Byler et al. | 205/138 |
| 5,352,266 | A | 10/1994 | Erb et al. | |
| 5,389,226 | A | 2/1995 | Scruggs et al. | |
| 5,433,797 | A * | 7/1995 | Erb et al. | 148/304 |
| 6,080,504 | A * | 6/2000 | Taylor et al. | 429/481 |
| 6,723,219 | B2 | 4/2004 | Collins | |
| 6,773,817 | B1 | 8/2004 | Sagel et al. | |
| 6,852,920 | B2 | 2/2005 | Sager et al. | |
| 7,045,050 | B2 * | 5/2006 | Tanaka et al. | 205/143 |
| 7,320,832 | B2 | 1/2008 | Palumbo et al. | |
| 7,329,334 | B2 | 2/2008 | Herdman et al. | |
| 7,387,578 | B2 | 6/2008 | Palumbo et al. | |
| 7,521,128 | B2 | 4/2009 | Schuh et al. | |
| 2003/0234181 | A1 * | 12/2003 | Palumbo et al. | 205/115 |
| 2005/0176270 | A1 * | 8/2005 | Luch | 439/67 |
| 2006/0154084 | A1 | 7/2006 | Schuh et al. | |
| 2006/0272949 | A1 | 12/2006 | Detor et al. | |
| 2006/0283539 | A1 * | 12/2006 | Slafer | 156/230 |
| 2009/0229984 | A1 | 9/2009 | Schuh et al. | |

FOREIGN PATENT DOCUMENTS

| | | |
|---|---|---|
| CN | 1526856 A | 12/2005 |
| JP | S61-037994 | 2/1986 |
| JP | H05-094914 | 4/1993 |
| JP | 2001-342591 | 12/2001 |
| WO | WO 99/14404 | 3/1999 |
| WO | WO 2004/001100 | 12/2003 |
| WO | WO 2006/063468 | 6/2006 |

OTHER PUBLICATIONS

Chinese Office Action from Chinese Application No. 200780022871.1, mailed May 31, 2010.

(Continued)

*Primary Examiner* — Nicholas A Smith
(74) *Attorney, Agent, or Firm* — Wolf, Greenfield & Sacks, P.C.

(57) ABSTRACT

Methods for the use of nanocrystalline or amorphous metals or alloys as coatings with industrial processes are provided. Three, specific, such methods have been detailed. One of the preferred embodiments provides a method for the high volume electrodeposition of many components with a nanocrystalline or amorphous metal or alloy, and the components produced thereby. Another preferred embodiment provides a method for application of a nanocrystalline or amorphous coatings in a continuous electrodeposition process and the product produced thereby. Another of the preferred embodiments of the present invention provides a method for reworking and/or rebuilding components and the components produced thereby.

10 Claims, 5 Drawing Sheets

(56) References Cited

OTHER PUBLICATIONS

International Search Report and Written Opinion from PCT/US2007/068548 mailed Sep. 30, 2008.
K.O. Legg, "Overview of Chromium and Cadmium Alternative Technologies," Surface Modification Technologies XV, ed. T.S. Sudarshan and M. Jeandin, ASM International, Materials Park, Ohio 2002, pp. 1-10.
European Supplemental Search Report from EP07783505.6, mailed Aug. 3, 2012.

* cited by examiner

200

METHODS FOR THE IMPLEMENTATION OF NANOCRYSTALLINE AND AMORPHOUS METALS AND ALLOYS AS COATINGS

CROSS REFERENCE TO RELATED APPLICATION

The present application is a divisional of U.S. patent application Ser. No. 11/383,969, now U.S. Pat. No. 7,521,128, filed May 18, 2006, which is incorporated herein by reference.

FEDERALLY SPONSORED RESEARCH

N/A

BACKGROUND OF THE INVENTION

The present invention generally relates to methods for the practical implementation of nanocrystalline or amorphous metals or alloys as coating materials. More particularly, methods of applying such nanocrystalline or amorphous metals or alloys to high volume electrodeposition operations, to continuous electrodeposition operations, and to the rebuilding and reworking of components are presented.

Industrial applications, such as high-volume electrodeposition production, barrel plating, continuous electrodeposition, and rework/rebuild require coating materials with specific properties. There is a continual need for new and improved coating materials for these applications, which can offer economic benefits or improved product properties.

High Volume Electrodeposition:

High volume electrodeposition coating processes, such as barrel plating, are economically and practically desirable for coating many components simultaneously. However, insufficient coating properties create significant challenges for these high volume electrodeposition coating processes.

High volume electrodeposition processes such as barrel plating generally involve more than two components being plated simultaneously, and which components may be in electrical contact with one another during at least part of the process. The parts may also experience contact mechanical loads and/or abrasive loading at the electrical contact points. Such loading may be increased if the components experience agitation during the process.

In design of high volume electrodeposition processes, an important issue is the character and properties of the deposited coating. In general, a weak or poorly adhered coating may be damaged by the agitation process, as components shift their relative positions and give rise to sliding contact points or local impacts on the component surfaces. Similarly, soft and malleable coatings, or those with low hardness, low resistance to wear, indentation, or frictional sliding damage, may acquire defects such as cracks, scratches or delaminations during the process. It is therefore important that the deposited coating have desirable properties that resist damage during processing, and that the process characteristics be controlled to avoid such damage.

Another coating property of importance to the efficiency and efficacy of a high volume electrodeposition process is its electrical conductivity. Because the electrical connection of each component to the power supply is achieved, in general, through contacts between components or between components and the electrical lead connected to the power supply, electrical current is required to pass across the surfaces of the components. As the deposition process proceeds and the components become coated, electrical current is required to pass through the coating material itself. If the coating is of low electrical conductivity, current flow is discouraged, reducing the efficiency of the deposition. For this reason, coatings of relatively higher electrical conductivity are generally more appropriate to high volume electrodeposition processes such as barrel plating.

An example relating to the electrical conductivity of electrodeposited coatings is provided by the case of hexavalent chromium deposits. Coatings of chromium produced by deposition from the hexavalent bath are desirable in many respects, due to the high hardness, wear resistance, and corrosion resistance of the coating. However, the electrical conductivity of hexavalent chromium coatings is low compared to many metals, and reduces the efficiency of a high volume process such as barrel plating. This renders such operations economically difficult to sustain.

A need has long existed for new electrodeposited coatings which combine new suites of properties, to be produced in high volume with such techniques. For example, it would be desirable to use a high-strength, strong adhesion, abrasion resistant nanocrystalline or amorphous coating with high electrical conductivity, to improve both the quality of the coating and coated product, as well as increase the efficiency of the process. Additionally desired properties include higher hardness, ductility, wear resistance, electrical properties, magnetic properties, corrosion characteristics, substrate protection, improved environmental impact, improved worker safety, improved cost, and many others.

Continuous Electrodeposition:

Continuous electrodeposition processes are economically and practically desirable for applying a coating onto a strip of material. A need has long existed for coatings being applied using continuous electrodeposition which create a final product with more desirable properties. For example, higher hardness, strength, ductility, wear resistance, electrical properties, magnetic properties, corrosion characteristics, substrate protection, improved environmental impact, improved worker safety, improved cost, and many others.

Rework/Rebuild:

Rework/rebuild processes are economically and practically desirable for correcting deficiencies in products. A critical step in the rework/rebuild process is the application of a suitable coating material. One common material used for this coating process is hard electrodeposited chromium, alternatively called "hard chromium" or "hard chrome". Rework/rebuild is a common procedure for chromium plating facilities, in which hard chromium is the material plated as a coating. Frequently, the chromium coating will be up to or in excess of 375 μm in thickness prior to the machining step. K. O. Legg cites rework and rebuild operations as comprising one of the largest single uses of hard chromium plating in his article "Overview of Chromium and Cadmium Alternative Technologies" (in Surface Modification Technologies XV, edited by T. S. Sudarshan and M. Jeandin, ASM International, Materials Park Ohio, 2002), which is fully incorporated herein by reference. A drawback of hard chromium coatings for rework/rebuild operations is the toxicity and carcinogenicity of the chemicals used in the coating process; these have serious implications for the environment and for worker safety.

Other coating technologies can be applied to rework operations, including but not limited to other electroplated metal technologies, electroless coatings, plasma or thermal spray coatings, and physical vapor deposition coatings. These coating technologies are generally more expensive than is hard chromium coating, but can mitigate the negative environmental issues associated with hard chromium. The main requirements for the coating used in rework/rebuild operations are that it be deposited to sufficient thickness, that it have the desired surface properties (i.e., resistance to corrosion, abrasion, erosion, wear, fatigue, etc.), that it adhere to the base material of the substrate component, and that it can be machined by a suitable method to exhibit the correct geometry.

Other factors may influence the choice of a coating technology for use in rework/rebuild operations. For example, the geometry of the component may preclude some coating technologies. Plasma spray coatings are not generally useful for coating internal diameters of bores or other re-entrant geometries, and so could not be used for rework/rebuild except for regions of the component material that may be connected by a line-of-sight to the spray nozzle. Similarly, hard chromium plating is often said to be a "low throwing-power" process, meaning that the process preferentially deposits chromium on portions of the component closer to a line-of-sight with a nearby plating anode. Many anodes are often used in parallel to improve the density of "sight lines" to the component and provide a uniform coating, but the coating of recesses, internal surfaces, and re-entrant geometries is often non-uniform. For these reasons, rework/rebuild operations on complex surfaces are generally more challenging than those on simpler geometries.

Accordingly, a need has long existed for coatings, coating materials, and coating application processes to be used in rework/rebuild operations that would provide the following: high strength and hardness, high corrosion resistance, high wear and abrasion resistance, thicknesses of at least 200 μm, improved environmental impact, improved worker safety, improved cost, improved ability to coat geometries with internal surfaces and non-line-of-sight surfaces, better compatibility or matching of the substrate material to the rework/rebuild coating, improved surface properties, the ability to withstand subsequent machining operations, and the ability to utilize existing electroplating equipment.

SUMMARY OF THE INVENTION

The present invention relates to methods for the use of nanocrystalline or amorphous metals or alloys as coatings by industrial processes. One of the preferred embodiments provides a method for coating many components with a nanocrystalline or amorphous metal or alloy, using a high volume electrodeposition process such as barrel plating and the components produced thereby. Another preferred embodiment provides a method for application of a nanocrystalline or amorphous coating in a continuous electrodeposition process and the product produced thereby. Another of the preferred embodiments of the present invention provides a method for reworking and/or rebuilding components and the components produced thereby.

These and other features of the present invention are discussed or apparent in the following detailed description.

DETAILED DESCRIPTION OF THE PREFERRED EMBODIMENTS

Figure 1:
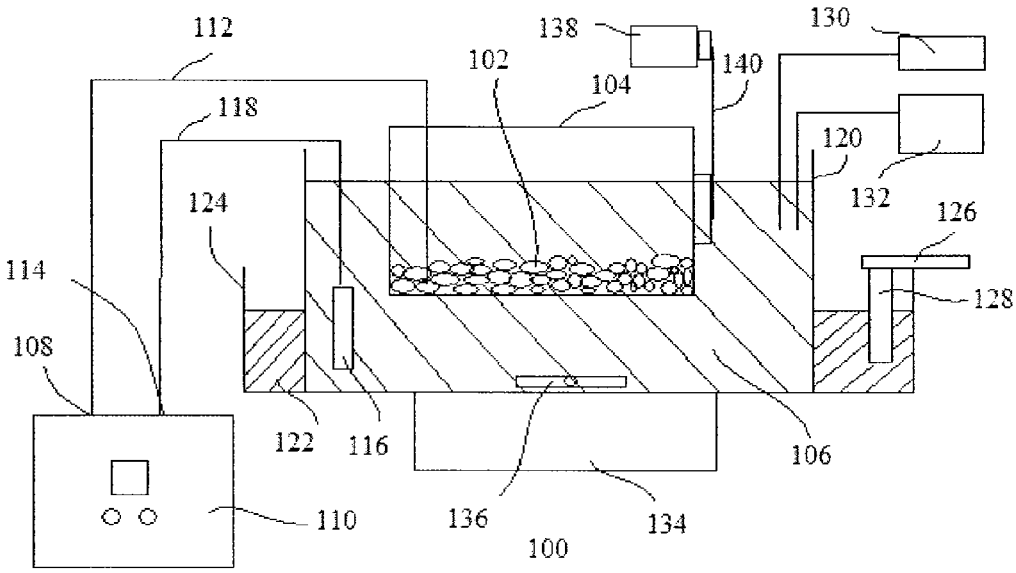
FIG. 1 illustrates a front view of a high volume electrodeposition apparatus suitable for the simultaneous coating of many parts in a high volume process.

Disclosed herein are methods for the implementation of nanocrystalline and amorphous metals and alloys as coatings. Specifically, three methods for implementation have been described: the simultaneous coating of many parts in a high volume electrodeposition process, the continuous electrodeposition of a coating, and the rework/rebuild of a component using a coating.

Nanocrystalline metal refers to a metallic body in which the number-average size of the crystalline grains is less than one micrometer. The number-average size of the crystalline grains provides equal statistical weight to each grain. The number-average size of the crystalline grains is calculated as the sum of all spherical equivalent grain diameters divided by the total number of grains in a representative volume of the body. Amorphous metal refers to a metallic body without long-range crystalline order, i.e., a metallic body which is solid but not crystalline. A metallic body which comprises regions of crystalline structure in addition to the amorphous regions is additionally included in the definition of an amorphous metal.

Nanocrystalline and amorphous metals and alloys are generally regarded as advanced structural materials, because as a materials class they tend to exhibit high strength, high abrasion resistance, high hardness, and other desirable structural and functional properties. Many technologies can be used to prepare nanocrystalline or amorphous metals or alloys, including some which naturally yield coatings. For example, electrodeposition processes can be used to synthesize nanocrystalline or amorphous metal or alloy coatings on electrically conductive surfaces. A coating produced by electrodeposition may be made in nanocrystalline form by many techniques, including addition of grain refining additives, deposition of an alloy that takes a nanocrystalline form, use of pulsed current, or use of reverse pulsed current. Recent technologies around the use of electrodeposition allow for precise control of the grain size in a nanocrystalline metal or alloy, which is desirable to adjust coating properties to the needs of a particular application.

Electrodeposition is commonly carried out in aqueous fluids, but is not restricted to aqueous systems. For example, the electrodeposition bath can comprise molten salts, cryogenic solvents, alcohol baths, etc. Any type of electrodeposition bath can be used in conjunction with the present inventions.

Electrodeposition involves the flow of electrical current through the deposition bath, due to a difference in electrical potential between two electrodes. One electrode is commonly the component or part which is to be coated. The process may be controlled by controlling the applied potential between the electrodes (a process of potential control or voltage control), or by controlling the current or current density that is allowed to flow (current or current density control). The control of the process may also involve variations, pulses, or oscillations of the voltage, potential, current, and/or current density. The method of control can also be a combination of several techniques during a single process. For example, pulses of controlled voltage may be alternated with pulses of controlled current or current density. In general, during an electrodeposition process an electrical potential exists on the component to be plated, and changes in applied voltage, current, or current density result in changes to the electrical potential on the component. Any such control methods can be used in conjunction with the present inventions.

Nanocrystalline and amorphous metal or alloy coatings are unique and offer desirable properties. The implementation of these materials and coatings in practical applications requires relevant methods of production for industrial applications. Thus, there is a need for new applications of nanocrystalline or amorphous metal or alloy coatings, especially those prepared by electrodeposition.

One specific method to control the grain size of electrodeposited nanocrystalline metals or alloys was presented by Detor and Schuh, in U.S. patent application Ser. Nos. 11/032,680 and 11/147,146, which are fully incorporated herein by reference. This method consists of carefully controlling the composition of an alloy deposit, which in turn allows for control of nanocrystalline grain size. For example, in electroplated alloys of Ni—W, Ni—P, and many others, there is a simple relationship between grain size and composition. In these cases higher W or P contents are correlated with finer nanocrystalline grain sizes. Control of the W or P level therefore allows one to tailor the grain size in the nanocrystalline range. Sufficiently high levels of W or P, in these examples, can lead to amorphous structures. The method of Detor and Schuh is to manipulate the electrodeposition process to control the composition, and thereby control the grain size in the nanocrystalline or amorphous deposit.

A specific application of the above method of Detor and Schuh is based on reverse pulsed current during the process. Reverse pulsing of the current allows control of the coating composition, and thereby allows control of grain size. This reverse pulse technique can produce coatings of tailorable grain size with reduced macroscopic defects such as cracks or voids.

This reverse pulsing technique involves the introduction of a bipolar wave current, with both positive and negative current portions, during the electrodeposition process. Using this technique provides the ability to adjust the composition of the deposit, its grain size, or both within a relatively quick amount of time, and without changing either the composition or temperature of the electrodeposition bath liquid. Further, the technique produces high quality homogeneous deposits with a lesser degree of voids and cracks than is conventionally achieved. The technique also enables grading and layering of nanocrystalline crystal size and/or composition within a deposit. Additionally, the technique is economical, scalable to industrial volumes, and robust.

It is possible to produce a variety of metals and alloys with nanocrystalline or amorphous structures using electrodeposition. For example, Ni—W alloys can be electrodeposited. Nanocrystalline or amorphous metals and alloys can be produced with a variety of different elemental compositions in an electrodeposition process with a variety of average grain sizes in the nanocrystalline range, and can be produced as an amorphous metallic form as well. As well, many Ni-based alloys including Ni—W, Ni—Mo, Ni—P, Ni—B, Ni—Fe, Ni—Co, Ni—S, and others can be electrodeposited in nanocrystalline or amorphous form. The inventions reported herein specifically apply to these electrodeposited metals and alloys in nanocrystalline or amorphous form, and to others as well. Co-based alloys such as Co—Mo, Co—W, Co—P and others are also possible, as are iron, copper, tin, cadmium, and zinc-based systems. Individuals skilled in the art will recognize many other metals or alloys, both commercial and experimental, which can be electrodeposited in nanocrystalline or amorphous form. The present invention may be used with any such existing metals or alloys, or new systems that may be developed in the future.

The present inventions also apply to composite systems, in which a nanocrystalline or amorphous metal or alloy is combined with additional phases. For example, hard particulates of metal, ceramic, intermetallic, or other material might be incorporated into a nanocrystalline or amorphous metal or alloy. Other potential phases which may be incorporated will also be recognized by those skilled in the art, such as solid lubricant particles of graphite or $MoS_2$. Nanocrystalline and amorphous phases may also coexist in a single electrodeposited coating, which represents another composite structure which is a straightforward variation that may be used in the present invention.

Nanocrystalline and amorphous metals and alloys can also exhibit a wide range of properties, depending upon their composition and structure. Of importance in this regard is a method which allows the grain size to be tailored, allowing the coating properties to be controlled in a manner that is desirable both for the functionality of the final coating, and for optimization of a high volume production process like barrel plating. For example, high electrical conductivity is desirable in barrel plating or other high volume electrodeposition processes, and by tailoring the grain size of a nanocrystalline deposit the conductivity may be increased to acceptable levels to permit efficient high volume production.

A particular method of producing a nanocrystalline or amorphous metal or alloy, and controlling and tailoring the grain size in the coating, is the method outlined by Detor and Schuh above. In this method the composition of the coating is tailored to control the grain size of the nanocrystalline deposit. This may be accomplished by many techniques, including, for example, the use of periodic reverse pulses that tailor the composition and grain size of the deposit.

Because electrodeposition processes can be adjusted to yield nanocrystalline or amorphous metal or alloy coatings using technologies such as those described above, there are potential industrial applications that will benefit from the improved properties of such coating materials.

High Volume Electrodeposition:

An invention disclosed herein is a method to simultaneously coat many components using a high volume electrodeposition process, using a nanocrystalline or amorphous metal or alloy coating. A related invention is a component that has been coated with a nanocrystalline or amorphous metal or alloy using a high volume electrodeposition process.

One industrial coating process in use in the electrodeposition or electroplating industry pertains to the rapid, low-cost coating of many components simultaneously. FIG. 1 illustrates a front view of a high volume electrodeposition apparatus 100 suitable for this simultaneous coating of many components 102 in a high volume process. The high volume electrodeposition apparatus 100 includes components 102, a component vessel 104, an electrodeposition bath 106, a component terminal 108, an electrical power supply 110, component electrical lead 112, a counter terminal 114, a suitable counter electrode 116, a counter electrical lead 118, a bath vessel 120, an oil bath 122, an oil bath vessel 124, a thermal controller 126, a heater 128, sensors 130, a composition adjustment module 132, a stirring apparatus 134, a moving stirrer 136, an agitation motor 138, and an agitation drive unit 140.

Such high volume electrodeposition operations are often carried out in a so-called barrel plating operation, in which many components 102 to be coated are placed into a component vessel 104, which contains or is contained within an electrodeposition bath 106. Some or all of the components 102 in the component vessel 104 are in contact with the electrodeposition bath 106, and the components 102 are all in electrical contact with one another in the vessel. The components 102 are further electrically connected to the component terminal 108 of an electrical power supply 110 through a component electrical lead 112, which is in contact with one or more of the components 102, but not necessarily all of the components 102.

The component electrical lead 112 can take many forms, and in general can be considered an assembly of parts in electrical contact with one another, whose function is to channel electric current to components. The component electrical lead 112 can be a conductive wire such as a metal wire, or a series of metal wires in electrical contact with one another. The component electrical lead 112 can also be a conductive rod or other geometry of conductive material, or an assembly of many such geometries. In some cases, functional geometries are part of the component electrical lead 112, as in the case of mechanical clips, clamps, screws, hooks, or brushes which facilitate electrical contact with components. The component electrical lead 112 need not be stationary, but can move due to the agitation of the process. For example, the component electrical lead 112 can be part of a rotating component vessel 104.

Electrical current passes from the electric power supply 110, through the component terminal 108, through the component electrical lead 112, and into the components 102 with which it is in contact, to the other components 102 via the physical contacts between the components 102. The other terminal of the electrical power supply 110 is the counter terminal 114 and is connected to a suitable counter electrode 116 through the counter electrical lead 118. The suitable counter electrode 116 is present in the electrodeposition bath 106 but does not contact the components 102 to be coated.

When electrical current is permitted to flow in this operation, provided that the conditions of the operation are appropriate for electrodeposition, metal ions in the electrodeposition bath 106 are deposited or plated onto the various components 102 that are in the component vessel 104, over the portions of the components 102 surfaces which are immersed in the electrodeposition bath 106. In this way, all of the components may be coated at the same time, as they are all part of a single electrode "system" that comprises many components 102.

The electrodeposition bath 106 is contained within the bath vessel 120. The bath vessel 120 sits within the oil bath 122, which is contained within the oil bath vessel 124. The thermal controller 126 is connected electronically to the heater 128, which extends into the oil bath 122. The temperature of the oil bath 122 is used to control the temperature of the electrodeposition bath 106. The heater 128, which is controlled by the thermal controller 128, heats the oil bath 122. There are many possible ways to control and maintain the proper temperature of the electrodeposition bath 106. The heater 128 can be directly placed in the electrodeposition bath 106, ambient environmental conditions can be used, etc.

Sensors 130 also extend into the electrodeposition bath 106. The sensors 130 include temperature, composition, pH, and viscosity measurement devices. Additional or fewer measurement devices can be included as sensors 130. A composition adjustment module 132 also extends in the electrodeposition bath 106. The composition adjustment module adds material to the electrodeposition bath based on data produced by the sensors 130. The sensors 130 also provide data used by the thermal controller 126.

It is often desirable for the electrodeposition bath 106 to be stirred. The stirring apparatus 134 creates a magnetic field which causes movement of the moving stirrer 136, thereby stirring the electrodeposition bath. Many methods exist for stirring the electrodeposition bath 106. The stirrer can be driven by a mechanical power source, components or other apparatus devices can be moved, etc. Pumps can also create aggressive fluid flow in the electrodeposition bath 106 to achieve stirring of the electrodeposition bath 106.

As the coating process proceeds, the points of contact between components 102 allow transmission of electrical current between them, but they may also shield the contact points and regions in their immediate vicinity from being thoroughly coated. For this reason, such barrel plating operations generally require some agitation of the components 102, to continuously re-locate the inter-component contact points as the coating process proceeds.

The agitation motor 138 is connected to and powers the agitation drive unit 140, which is connected to the component vessel 104. Movement of the agitation drive unit 140 causes movement of the component vessel 104, which causes movement and agitation of the components 102.

The agitation can be achieved in many ways, such as by vibrating the component vessel 104 and its contents (including the components 102), by rotating or revolving the vessel, moving a belt on which the parts rest as is used in the Technic Tumbleplater process. Aggressive fluid flow of the electrodeposition bath 106 induced by pumps can also be used to agitate the components 102. Of such agitation methods, rotation of the vessel is most commonly employed. The component vessel 104 need not be a barrel, it can be any device capable of holding the components 102.

Agitation of the components 102 and/or component vessel 104 provides for redistribution of the electrical contact points between the various components 102, as well as the contact between some of the components 102 and the component electrical lead 112 connected to the electric power supply 110. It helps prevent non-uniform coating of the components 102 near such contacts, and can also prevent the coating from forming a permanent bond between components 102 at their contact points. Agitation can be carried out continuously or in shorter periods separated by periods without agitation.

Agitation can have many other benefits for an electrodeposition coating process. It can lead to detachment of undesirable gas bubbles from coating surfaces (e.g., hydrogen bubbles). Agitation can also serve to cycle some components into and out of the electrodeposition bath 106. Agitation can also affect the quality of the coated product, by leading to such things as leveling and improved surface finish.

High volume electrodeposition processes such as barrel plating can be conducted in a batch mode, or in a continuous mode. In a continuous operation some mechanism of introducing and removing components 102 at a regular rate is introduced.

Some or all of the components 102 in a high volume electrodeposition process can be partly or completely masked, as by a paint or tape applied to parts of the components 102 surface upon which no coating is desired. Thus, although an entire individual component 102 is exposed to the deposition fluid, the masked portions of the surface would not be involved in electrodeposition. In a system using agitation to relocate electrical contacts between components 102, contacts with the masked portions of a component 102 may not conduct electrically. In this case, some components 102 may be out of electrical contact for some period or periods of time during the process. In general, agitation should be sufficient to render these periods insignificant, or to insure that similar total such periods are experienced by all components 102.

In design of a high volume electrodeposition process, it is important that the agitation process is not too severe. Severe agitation can cause mechanical damage to the components 102 being coated, which may be small and delicate.

High volume electrodeposition coating methods, such as the barrel plating process and Technic Tumbleplater Process, can be adapted to use various technologies to yield nanocrystalline or amorphous electrodeposits. This would allow for high volume coating of components with nanocrystalline or amorphous coatings. Nanocrystalline and amorphous metals and alloys exhibit many of the desirable properties important to high volume or barrel plating. They are generally strong and resist contact damage, abrasion and wear; these properties are desirable to avoid damage to the coating and the components during high volume electrodeposition processing. Furthermore, the electrical conductivity of a nanocrystalline or amorphous metal or alloy may be high, facilitating the passage of electrical current across contacts between components 102 or across the contact between a component 102 and the component electrical lead 112 connected to the electric power supply 110.

It is a preferred embodiment of the present invention to use the method of Detor and Schuh for electrodepositing nanocrystalline or amorphous alloys or metals as coatings, using a high volume production process like barrel plating or the Technic Tumbleplater process, and to induce a desired nanocrystalline grain size by controlling the composition of the deposited alloy. Another embodiment of the invention uses the method of Detor and Schuh where the composition of the deposit is controlled by using a designed periodic reverse pulse process during deposition, in order to control the grain size. By controlling and tailoring the grain size, desired material properties in the coating can be achieved.

Continuous Electrodeposition:

An invention disclosed herein is a continuous electrodeposition process including the deposition of a nanocrystalline or amorphous metal or alloy coating. A related invention is the product coated by a nanocrystalline or amorphous metal or alloy in a continuous process.

Figure 2:
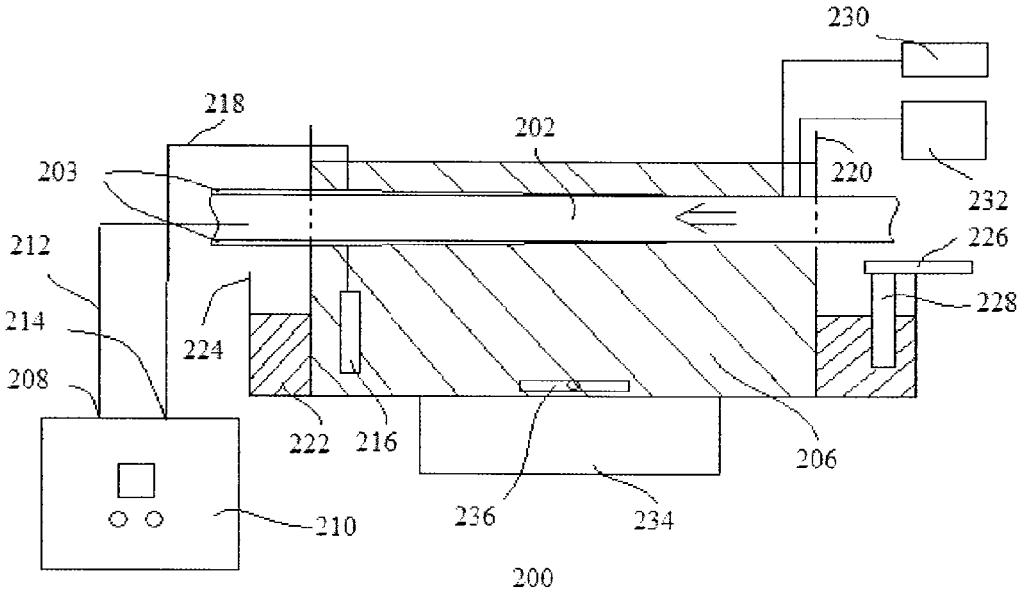
FIG. 2 illustrates a front view of an apparatus suitable for the continuous electrodeposition of a coating.

A high-volume electrodeposition processes based on continuous electrodeposition is also in use in industry. FIG. 2 illustrates a front view of a continuous electrodeposition apparatus 200 suitable for the continuous coating of a component strip 202 in a high volume process. The continuous electrodeposition apparatus 200 includes a component strip 202, a component coating 203, an electrodeposition bath 206, a component terminal 208, an electrical power supply 210, component electrical lead 212, a counter terminal 214, a suitable counter electrode 216, a counter electrical lead 218, a bath vessel 220, an oil bath 222, an oil bath vessel 224, a thermal controller 226, a heater 228, sensors 230, a composition adjustment module 232, stirring apparatus 234, and a moving stirrer 236.

Continuous deposition of a coating onto a component strip 202, such as a strip of metal, can be achieved if a continuous feed of the component strip 202 is traveling through the electrodeposition bath 206, and the component strip 202 is made an electrode as in a conventional deposition process. Unlike a conventional electrodeposition process in which a component is dipped into the electrodeposition bath, continuous deposition involves the component strip 202 traveling through the electrodeposition bath 206 whereby a beginning portion of the component strip 202 enters the electrodeposition bath 206 before an adjoining portion of the component strip 202 and the beginning portion of the component strip 202 also exits the electrodeposition bath 206 before the adjoining portion of the component strip 202. As the component strip 202 travels through the electrodeposition bath 206 the component coating 203 is applied.

The component strip 202 to be coated enters the electrodeposition bath 206, which contains or is contained within an electrodeposition bath 206. A portion of the component strip 202 is in contact with the electrodeposition bath 206. The component strip 202 is further electrically connected to the component terminal 208 of an electrical power supply 210, through a component electrical lead 212, which is in contact with the component strip 202. The component electrical lead 212 includes anything used to contact with the component strip 202, such as a wire, rod, alligator clip, screw, clamp, etc.

Electrical current passes from the electric power supply 210, through the component terminal 208, through the component electrical lead 212, and into the component strip 202. The other terminal of the electrical power supply 210 is the counter terminal 214 and is connected to a suitable counter electrode 216 through the counter electrical lead 218. The suitable counter electrode 216 is present in the electrodeposition bath 206, but does not contact the component strip 202.

When electrical current is permitted to flow in this operation, provided that the conditions of the operation are appropriate for electrodeposition, metal ions in the electrodeposition bath 206 are deposited or plated onto the portion of the component strip 202 which is immersed in the electrodeposition bath 206.

The electrodeposition bath 206 is contained within the bath vessel 220. The bath vessel 220 sits within the oil bath 222, which is contained within the oil bath vessel 224. The thermal controller 226 is connected electronically to the heater 228, which extends into the oil bath 222. The temperature of the oil bath 222 is used to control the temperature of the electrodeposition bath 206. The heater 228, which is controlled by the thermal controller 228, heats the oil bath 222. There are many possible ways to control and maintain the proper temperature of the electrodeposition bath 206. The heater 228 can be directly placed in the electrodeposition bath 206, ambient environmental conditions can be used, etc.

Sensors 230 also extend into the electrodeposition bath 206. The sensors 230 include temperature, composition, pH, and viscosity measurement devices. Additional or fewer measurement devices can be included the sensors 230. A composition adjustment module 232 also extends in the electrodeposition bath 206. The composition adjustment module adds material to the electrodeposition bath based on data produced by the sensors 230. The sensors 230 also provide data used by the thermal controller 226 used to control the temperature.

It is often desirable for the electrodeposition bath 206 to be stirred. The stirring apparatus 234 creates a magnetic field which causes movement of the moving stirrer 236, thereby stirring the electrodeposition bath. Many methods exist for stirring the electrodeposition bath 206. The stirrer can be driven by a mechanical power source, components 102 or other apparatus devices can be moved, etc. Pumps can also create aggressive fluid flow in the electrodeposition bath 206 to achieve stirring.

In a continuous process, the component strip 202 to be coated can travel through a stationary electrodeposition bath 206, or the electrodeposition bath 206 may be translated along its length. The electrodeposition bath 206 need not be contained in a bath vessel 220, for example a traveling sprayed bath, which may or may not recirculate the bath fluid, can be used. Both the electrodeposition bath 206 and component strip 202 can also be in motion, provided that there is a net relative motion of the electrodeposition bath 206 and component strip 202 with respect to one another. A flexible component strip 202 can also deflect or curve to enter the electrodeposition bath 206 rather than traveling straight through the electrodeposition bath 206.

Furthermore, the relative motion of the component strip 202 with respect to the bath need not be uninterrupted, smooth, or perfectly continuous. Periodic discrete advances of the component strip 202, for example, constitute a continuous process with an average feed rate given by the sum of the lengths of each advance divided by the sum of the dwell times after each advance and the sum of the times involved in each advance. Furthermore, periods of reverse relative motion of the component strip 202 in the deposition bath 206 are possible and affect the average feed rate of the process, but do not limit the generality of the present inventions.

The component strip 202 may be fed from one reel to another in a continuous fashion, or part of a larger manufacturing operation. Additionally, the geometry of the component strip 202 is arbitrary in such an operation. Component strips 202 such as Wires, rods, I-beams, sheets, perforated sheets or strips, extrusions, or even more complex geometries can be coated in high volumes through a continuous process.

Part or all of the component strip 202 geometry can be coated. By masking or otherwise preventing current flow to some portions of the geometry, it is possible to selectively coat, for example, one side of a sheet or strip, one edge of a rectangular beam, or a length-wise groove or raised feature on a complex geometry.

In continuous processes such as described above, the coating material is chosen for its desirable properties in the final coated product. Some desirable properties may be high hardness, high strength, ductility, wear resistance, electrical properties, magnetic properties, corrosion characteristics, substrate protection, and many others.

Continuous electroplating operations can also be adapted to incorporate technologies that allow the deposition of nanocrystalline or amorphous metals or alloys. Continuous operations include the coating of a continuous feed of a component strip 202 or sheet of metal, where the component strip 202 or sheet is made an electrode as in a conventional deposition process. Such component strip 202 may be fed from one reel to another in a continuous fashion, or part of a larger manufacturing operation with or without feeding reels. Additionally, the geometry of the component strip 202 is arbitrary in such an operation. Component strips 202 such as wires, rods, I-beams, sheets, perforated sheets or strips, extrusions, or even more complex geometries can be coated in high volumes through a continuous process. Part or all of the geometry can be coated in this manner. By masking or otherwise preventing current flow to some portions of the geometry, it is possible to selectively coat, for example, one side of a sheet or strip, one edge of a rectangular beam, or a length-wise groove or raised feature on a complex geometry.

A continuous plating process can also be used to coat a series of discrete components, which are assembled into a continuous strip. For example, a sheet of metal can be perforated into many individual components that are connected to one another, and this connected strip of components moved through the deposition bath to coat the components. Individual components can also be assembled into a continuous strip by many other methods that provide an electrical contact between components along the length of the strip. For example, a traveling wire or cable upon which a series of hooks are affixed may be used to hang many components, which travel through the deposition bath with the wire. Other continuous processes involving discrete components will be apparent to those skilled in the art, and any such processes may be used in conjunction with the present invention.

In a preferred embodiment of the present invention, a continuous electroplating operation is adapted to produce a nanocrystalline or amorphous metal or alloy coating, where the method of Detor and Schuh described above is used to effect nanocrystalline grain size of a desired dimension, or an amorphous structure, in the coating material. In its most general form, the method of Detor and Schuh employs control of the alloy composition of the coating to control the nanocrystalline grain size. Another embodiment of the invention is to use the method of Detor and Schuh via the application of a periodic reverse pulse to control the coating composition and grain size, in a continuous electrodeposition process.

Rework/Rebuild:

Another invention disclosed herein is a rework/rebuild process including the use of a nanocrystalline or amorphous metal coating. A related invention is a component that has been reworked or rebuilt using a nanocrystalline or amorphous metal coating.

Another use of electrodeposited coatings is for the reworking and rebuilding of components. The terms "rework" and/or "rebuild", collectively—"rework/rebuild," are defined herein to describe a process of depositing a coating material atop a substrate material or component in order to bring the dimensions of the component to within a specified tolerance and/or repair surface defects in the component. These processes are also sometimes referred to as "remanufacturing" in the literature.

Figure 3:
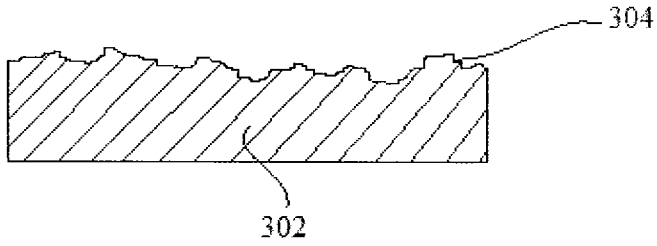
FIG. 3 illustrates a side view of a worn component in need of rework/rebuild.

FIG. 3 illustrates a side view of a worn component 302 in need of rework/rebuild. The worn component 302 has a worn surface 304 which is need of rework/rebuild. A worn surface 304 is one, which, owing to its use in service, has experienced abrasion, erosion, wear, corrosion, or any other such process or combination of processes that may tend to remove some material and consequently alter the shape of the component. A worn surface 304 can also be a result of the initial component 302 manufacturing process.

Figure 4:
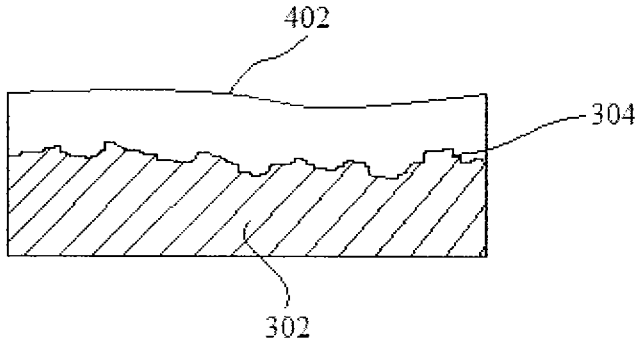
FIG. 4 illustrates a side view of a component in need of rework/rebuild after a coating has been applied.

FIG. 4 illustrates a side view of a worn component 302 in need of rework/rebuild after a coating has been applied. Rework/rebuild is used as a means of replenishing the worn material by first depositing fresh material in the form of an applied coating 402.

Figure 5:
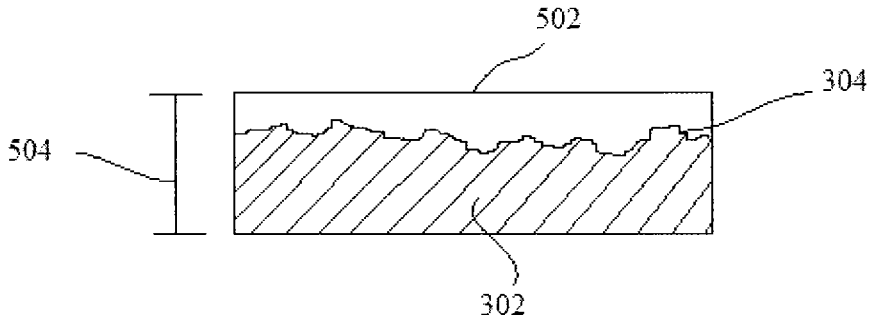
FIG. 5 illustrates a side view of a component after completion of rework/rebuild.

FIG. 5 illustrates a side view of a worn component 302 after completion of rework/rebuild. After the application of the applied coating 402, subsequent machining is performed on the applied coating 402, creating a machined surface 502. The machined surface 502 brings the worn component 302 back to within an acceptable dimensional tolerance 504 of its intended shape. Rework/rebuild might also be used to repair defects in a material that has not been put into service, but which developed defects during synthesis and processing stages, or perhaps developed such defects unintentionally by misuse or during handling or storage. Defects formed during the application of a coating may also be reworked.

In some cases, the wear, abrasion, corrosion, or erosion that a component experienced may have involved the degradation not only of the worn component's 302 base material, but also of a coating material previously applied to the component. In this case the rework/rebuild process often begins by removal (stripping) of the original coating material prior to the subsequent application of a new coating for the purpose of rebuilding the component. Rework/rebuild can also apply to components upon which the only wear or degradation occurred on a prior coating layer, where only said coating layer requires rework.

Rework/rebuild can also be used on worn components 302 which underwent a surface degradation process that did not involve material removal, for example oxidation, abrasion, or fatigue crack growth. In these cases, rework/rebuild can be preceded by a surface finishing process such as machining, polishing, shot peening, chemical milling, etc. In this case the rework process would rebuild material removed by the surface finishing process rather than that removed by virtue of abrasion or corrosion in service.

Although rework/rebuild is a process most commonly applied to components that experience mechanical loads (i.e., machine components or structural components), the process is quite general and may have application in many other domains including for components with electrical, electronic, magnetic, anti-corrosive, optical, aesthetic, medical, or other functional or decorative properties.

After the application of a suitable coating, a machining operation is often used to form the coated component into a desirable geometry. The term 'machining' may refer to conventional machine shop operations including milling, grinding, filing, or turning on a lathe, or can more generally refer to any process by which some of the coating material is removed. This can include mechanical polishing, chemical polishing, combined mechanical-chemical polishing, electro-chemical milling, electro-chemical etching, or electro-chemical polishing.

In some instances, a machining operation is not required at all for a rework/rebuild operation, if the deposited coating brings the geometry of the component to within the required dimensional tolerance without the need for machining.

The rework/rebuild process includes three stages: surface preparation, coating, and machining. The first stage involves preparing the surface of the component to be reworked/rebuilt for the later coating. This surface preparation includes cleaning, removal (stripping) of an original coating material, machining, polishing, shot peening, chemical milling, etc. Surface preparation is not always required and includes any operations which prepares the surface for further rework/rebuild processing. The second stage involves coating the surface of the component to be reworked/rebuilt; an invention contained herein is to use a nanocrystalline or amorphous metal coating.

Nanocrystalline and amorphous metals are desirable for rework/rebuild operations because they are generally very strong, hard, and can exhibit improved abrasion and corrosion resistance as compared with their more conventional microcrystalline counterparts (which have an average crystalline grain size above one micrometer).

Electrodeposition is a common technology for the application of coatings. Accordingly, existing electrodeposition equipment can be used to apply the nanocrystalline and amorphous metallic coatings.

Coatings of 200 μm or thicker are generally required for rework/rebuild operations. Nanocrystalline metal coatings greater than 200 μm in thickness can be produced by electrodeposition. Amorphous metals can also be electrodeposited to the required high thicknesses for rebuild/rework, as explained in U.S. patent application Ser. No. 11/032,680 by Schuh and Detor, which is included fully herein by reference.

Thus, electrodeposition can be used to produce nanocrystalline and amorphous coatings of the proper thickness and desirable properties for a rework or rebuild operation. They also generally have desirable high hardness and abrasion resistance, and can be machined, polished, electro-chemically milled, or otherwise treated to achieve a desirable final geometry. Electrodeposited nanocrystalline and amorphous metals are therefore ideal for rework/rebuild operations.

A technique for the electrodeposition of nanocrystalline metals is that of Detor and Schuh described above. This technique controls the composition of an alloy deposit in order to control the grain sizes of a nanocrystalline or amorphous alloy. It is a preferred embodiment of the present invention to use the method of Detor and Schuh for the purpose of rebuild and rework.

Another embodiment of the invention is to use periodic reverse pulsing to control composition, and thereby to control grain size of a nanocrystalline coating. This reverse pulse technique is particularly suited for the purpose of rework and rebuild because it produces coatings of tailorable grain size without macroscopic defects such as cracks or voids.

This reverse pulsed technique involves the introduction of a bipolar wave current, with both positive and negative current portions, during the electrodeposition process. Using this technique provides the ability to adjust the composition of the deposit, its grain size, or both within a relatively quick amount of time, and without changing either the composition or temperature of the electrodeposition bath liquid. Further, the technique produces high quality homogeneous deposits with a lesser degree of voids and cracks than is conventionally achieved. The technique also enables grading and layering of nanocrystalline crystal size and/or composition within a deposit. Additionally, the technique is economical, scalable to industrial volumes, and robust.

Thus, the reader will see that this invention provides a method of rework/rebuild and an article of that method that provides many benefits. A nanocrystalline and/or amorphous metal coating for rework/rebuild provides: high strength and hardness, high corrosion resistance, high wear and abrasion resistance, thicknesses of at least 200 μm, improved environmental impact or worker safety as compared with prior art (e.g., when using a Ni-based, Co-based or Cu-based nanocrystalline or amorphous metal instead of hard chromium), improved cost (e.g., when using an electrodeposited nanocrystalline or amorphous coating instead of a physical vapor deposited or plasma sprayed coating), improved ability to coat geometries with internal surfaces and non-line-of-sight surfaces (e.g., when using a high throwing-power electrodeposition process for a nanocrystalline or amorphous Ni-based alloy, as compared with a line-of-sight process such as plasma spray coating or a lower throwing-power electrodeposition process such as hard chromium plating), better compatibility or matching of the substrate material to the rework/rebuild coating (e.g., if a nanocrystalline or amorphous Ni-based coating is used atop a nickel based alloy for better matching of the elastic properties, as compared with the use of hard chromium atop the nickel based alloy, which have different elastic properties), improved surface properties (e.g., if a nanocrystalline or amorphous form with better corrosion resistance is used instead of hard chromium), ability to withstand subsequent machining operations, and the ability to utilize existing electroplating equipment.

While the above description contains much specificity, these should not be construed as limitations on the scope of the invention but rather as an explanation of one preferred embodiment thereof. Many other variations are possible. Accordingly the scope of the invention should be determined not by the embodiments illustrated but by the appended claims and their legal equivalents.

Partial Summary:

Inventions disclosed and described herein include methods for the use of nanocrystalline or amorphous metals or alloys as coatings by industrial processes. Processes of manufacture using such coatings are described, as are products incorporating or using such coatings.

Thus, this document discloses many related inventions.

One invention disclosed herein is an article of manufacture comprising a nanocrystalline or amorphous material applied to a component, whereby the nanocrystalline or amorphous material is applied through an electrodeposition process where an electric potential exists on the component through an electrical contact with other components.

The electrodeposition process may be tailored to produce a specific grain size. The electrodeposition process may also be tailored to apply material with more than one grain size, or with varying composition or grain size.

According to one preferred embodiment, the article of manufacture comprises a nanocrystalline or amorphous material applied to a component, whereby the nanocrystalline or amorphous material is applied through an electrodeposition process where an electric potential exists on the component through an electrical contact with other components, and the process uses a vessel to hold multiple components.

According to another set of preferred embodiments, the electrodeposition process involves an electrical potential having periods of both positive polarity and negative polarity, or in which the electrodeposition process involves an electrical potential that is pulsed more than once.

A related set of preferred embodiments involves the deposition of a nanocrystalline or amorphous Ni-based coating containing one of the elements W, Mo, P, or B, in conjunction with an electrical potential having periods of both positive and negative polarity, or in which the electrodeposition process involves an electrical potential that is pulsed more than once.

In yet another preferred embodiment, the article of manufacture comprises a nanocrystalline or amorphous material applied to a component, whereby the nanocrystalline or amorphous material is applied through an electrodeposition process where an electric potential exists on the component through an electrical contact with other components, and where the electrical contact with other components is changing as a result of agitation of the components.

Another invention disclosed herein is an article of manufacture comprising a nanocrystalline or amorphous metal applied to a component whereby the nanocrystalline or amorphous metal is applied through an electrodeposition process with a beginning portion of the component entering the electrodeposition bath before an adjoining portion of the component and the beginning portion of the component also exiting the electrodeposition bath before the adjoining portion of the component.

The electrodeposition process may be tailored to produce a specific grain size. The electrodeposition process may also be tailored to apply material with more than one grain size, or with varying composition or grain size.

The electrodeposition process may involve an electrical potential existing on the component.

According to a set of preferred embodiments, the article of manufacture comprises a nanocrystalline or amorphous metal applied to a component whereby the nanocrystalline or amorphous metal is applied through an electrodeposition process with a beginning portion of the component entering the electrodeposition bath before an adjoining portion of the component and the beginning portion of the component also exiting the electrodeposition bath before the adjoining portion of the component, and the electrodeposition process involves an electrical potential having periods of both positive polarity and negative polarity, or in which the electrodeposition process involves an electrical potential that is pulsed more than once.

A related set of preferred embodiments involves the deposition of a nanocrystalline or amorphous Ni-based coating containing one of the elements W, Mo, P, or B, in conjunction with an electrical potential having periods of both positive and negative polarity, or in which the electrodeposition process involves an electrical potential that is pulsed more than once.

Still another invention disclosed herein is an article of manufacture comprising a nanocrystalline or amorphous material applied to a component for a purpose of repairing damage to a component surface or bringing the geometry of the component to within a desired dimensional size.

The application of a nanocrystalline or amorphous metal can comprise an electrodeposition process. The application of a nanocrystalline or amorphous metal can also comprise an electrodeposition process tailored to produce a specific grain size, or tailored to apply material with varying composition or grain size.

In a set of related preferred embodiments, the application of a nanocrystalline material comprises an electrodeposition process with an electrical potential having periods of both positive polarity and negative polarity, or where the electrical potential is pulsed more than once.

A related set of preferred embodiments involves the deposition of a nanocrystalline or amorphous Ni-based coating containing one of the elements W, Mo, P, or B, in conjunction with an electrical potential having periods of both positive and negative polarity, or in which the electrodeposition process involves an electrical potential that is pulsed more than once.

In a final preferred embodiment, an article of manufacture comprises a nanocrystalline or amorphous material applied to a component for a purpose of repairing damage to a component surface or bringing the geometry of the component to within a desired dimensional size, where the component surface receives subsequent processing to bring the geometry of the component to within a desired dimensional size.

What is claimed is:

1. A method of manufacturing a component strip, comprising:

applying a nanocrystalline or amorphous material coating to a component strip, wherein the component strip is perforated and includes a series of components along a length of the strip, wherein the nanocrystalline or amorphous material coating comprises a nickel-tungsten alloy and continuously covers the components, wherein the nanocrystalline or amorphous material coating is applied through an electrodeposition process, said electrodeposition process comprised of a beginning portion of the component strip entering an electrodeposition bath before an adjoining portion of the component enters the electrodeposition bath and the beginning portion of the component strip also exiting the electrodeposition bath before the adjoining portion of the component strip exits the electrodeposition bath.

2. The method according to claim 1, wherein the electrodeposition process is tailored to produce a nanocrystalline material having a specific grain size.

3. The method according to claim 1, wherein the electrodeposition process is tailored to apply a nanocrystalline or amorphous material with varying compositions or grain sizes.

4. The method according to claim 1, wherein the electrodeposition process involves the application of a reverse pulsed current.

5. The method according to claim 1, wherein the electrodeposition process involves an electrical potential having periods of both positive polarity and negative polarity.

6. The method according to claim 1, wherein the electrodeposition process involves an electrical potential that is pulsed more than once.

7. The method according to claim 1, wherein the electrodeposition process involves the application of a reverse pulsed current.

8. The method according to claim 1, wherein an electric potential exists on the component.

9. A product manufactured according to the process of claim 1.

10. The method according to claim 1, wherein a portion of the component strip is masked.

* * * * *